US005351880A

United States Patent [19]

Goudreau

[11] Patent Number: 5,351,880

[45] Date of Patent: Oct. 4, 1994

[54] MULTIPLE TIER FOOD PACKAGE

[75] Inventor: Rodney A. Goudreau, West Warren, Mass.

[73] Assignee: Eastern Container Corporation, Springfield, Mass.

[21] Appl. No.: 58,177

[22] Filed: May 10, 1993

[51] Int. Cl.[5] ..... B65D 5/48

[52] U.S. Cl. ..... 229/120.32; 229/109; 229/174; 229/178

[58] Field of Search ..... 229/120.14, 120.15, 229/120.19, 120.32, 109, 165, 174, 175, 178, 110

[56] References Cited

U.S. PATENT DOCUMENTS

| | | | |
|---|---|---|---|
| 454,636 | 6/1891 | Brown et al. | 229/174 X |
| 2,174,563 | 2/1939 | Turner | 229/109 |
| 2,347,422 | 4/1944 | Loth | 229/109 |
| 2,819,833 | 1/1958 | Sauer | 229/109 |
| 3,291,367 | 12/1966 | Carter | 229/147 |
| 3,889,868 | 6/1975 | Brackner et al. | 229/147 X |
| 4,736,885 | 4/1988 | Negus, Sr. | 229/110 |
| 4,793,546 | 12/1988 | Nunn | 229/110 X |
| 4,957,237 | 9/1990 | Madonna et al. . | |
| 4,979,667 | 12/1990 | Seaman . | |
| 4,984,734 | 1/1991 | Zion et al. . | |
| 5,002,221 | 3/1991 | Ragan | 229/120.32 |
| 5,071,062 | 12/1991 | Bradley et al. . | |
| 5,180,075 | 1/1993 | Montalbano | 229/120.32 X |
| 5,211,329 | 5/1993 | Patton | 229/151 X |

*Primary Examiner*—Allan N. Shoap
*Assistant Examiner*—Christopher J. McDonald
*Attorney, Agent, or Firm*—Richard H. Kosakowski

[57] ABSTRACT

A box for containing two or more vertically stacked products, such as pizzas, includes a plurality of vertical side panels, along with horizontal bottom and top panels. At selected corners where pairs of adjacent side panels come together there are formed knock-in tabs that act as shelf supports for an upper product. Each tab is formed by cutting two parallel slits through the box material. The tabs are pushed inwardly towards the inside of the box to provide shelf supports for a disk upon which a product is placed. The tabs provide for ventilation into the box. The top of the box has a pair of flaps and associated tuck tabs that cooperate with a locking roll-over on the front side panel of the box to provide for a quick and easy means of opening and closing the box.

24 Claims, 3 Drawing Sheets 100
104
106
108
110
112
114
116
118
122
126
130
132
134
136
140
142
158
162
164
168
172
180
184
186
190
194
198
202
206
210
214
218
222
226
230
234
238
242
246
250
254
258
262
264
268
272
276
280
284
288
292
300
304
308
312
316
320
324
328
332
336
340
344
348
352
356
360
364
368
372
376

MULTIPLE TIER FOOD PACKAGE

BACKGROUND OF THE INVENTION

This invention relates generally to packaging of food products, and more particularly to a foldable box for vertically stacking two or more food products such as pizza pies or other foods, or containers holding food, for transportation to a place of consumption.

In the commercial sale of food products, such as the ever-popular pizza pie, the product is often transported from where it is made and/or cooked to a place of consumption at a remote site, be it a residence, place of business, etc. It is typically either the purchasing customer or a delivery person who transports the pizza, often by automobile, to its place of consumption. This concept of "take-out" food has, in general, increased in popularity in recent years. Thus, there has been a need to properly store and protect the pizza during transportation.

The customer who consumes the pizza in a remote site desires that the pizza be maintained in its best condition while en route thereto. Thus, it is desirable that the pizza arrive warm, and without getting soggy and/or crushed.

A number of different means for packaging a pizza have been developed over the years with the aforementioned goals in mind. It is known in the art to place the normally-round pizza on a similarly-round corrugated or other disk, and then place both the single pizza and associated disk in a paper bag that is then stapled or taped closed. However, this method often allowed the pizza to become soggy since no moisture was able to escape the closed bag. Also, the paper bag provided virtually no protection against crushing. Further, the paper did not act as a good insulator for allowing the pizza to retain its warmth. Thus, often the pizza was not pleasingly edible by the time it reached its place of consumption.

Later on, it was known in the art to provide a chipboard box to house the pizza during transport. See, for example, U.S. Pat. Nos. 4,979,667 and 5,071,062. However, the early cardboard boxes were somewhat flimsy. Therefore, they were not much better at protecting the pizza than the aforementioned paper bags.

More recently, pizzas have been offered in a corrugated version of the older-style chipboard box, due to the fact that corrugated offers more crush resistance and reduces heat loss of the food product.

Most recently, the concept of pizza delivery has increased in popularity. Also, the concept of the pizza maker offering two pizzas for the price of one, or one pizza at full price and a second pizza at a reduced price, has increased in popularity. Thus, it has become more commonplace for a delivery person to make multiple stops on a route to deliver one or more pizzas to a plurality of different places of consumption. Also, the consumer who eschews delivery service and transports the pizzas home by himself/herself will often take home more than one pizza.

Thus, the need to properly transport multiple pizzas has spawned several solutions in the prior art. One has been simply to provide a large corrugated box and lay the pizzas therein side by side. However, this becomes cumbersome as the size of the pizzas increases. Also, the transporting vehicle may not be able to accommodate such a large box.

It is possible to transport two or more pizzas arranged vertically with respect to one another. See, for example, U.S. Pat. Nos. 4,984,734, 4,957,237 and 5,002,221. The goal of properly transporting multiple pizzas in a single structure necessarily dictates that the design and functioning of the box become more important than boxes for merely transporting a single pizza. The '734 patent to Zion et al. provides for a single carton tray per pizza, with the carton trays being vertically stackable on one another such that the bottom panel of an upper carton tray serves as the cover for the adjacent lower carton tray. The '237 patent to Madonna et al. provides for a single box with an internal platform that divides the box into separate vertical sections for storing two pizzas.

The '221 patent to Ragan discloses a single, rectangular-shaped box that houses two or more pizzas. The rectangular-shaped box provides for supports at the four corners of the box for a rectangular disk upon which an upper pizza rests. In a sense, the '221 patent to Ragan provides for more efficient use of cardboard than the aforementioned '734 or '237 patents.

However, the box described in the Ragan patent is not without its drawbacks. Because of the rectangular shape of the box, the shelf supports are located at the extreme outer corners of the box. Such locations may provide insufficient support for the upper pizza; that is, the upper pizza may sag and even break. Ragan attempts to alleviate this problem by adding a separator stand on top of the lower pizza in the center thereof. However, this necessitates placing a plastic object on the top edible surface of the pizza. The separator stands forecloses any clear span (i.e., clearance) that existed between the top of the lower pizza and the bottom of the upper pizza. Also, now three pieces—the box, disk and stand—instead of two, must be purchased, inventoried, and put together. This adds to the total packaging cost. Further, the stand may not be of a material that is friendly to the environment. Still further, the stand precludes usage of the box concept in Ragan for such items as apple pies. This is because the stand would harm the pie upon which it rests.

Accordingly, it is a general object of the present invention to provide an improved box for containing two or more products, such as food products—specifically, pizzas—stacked in a vertical manner, such that the products arrive at their destination in a desirable condition.

It is a primary object of the present invention to provide a box for containing multiple perishable food products, such as pizzas, that maintains the food products in their best possible condition throughout transportation by retaining the warmth of the food products, by providing ventilation to allow excess moisture to escape so that the food products do not become soggy, and by preventing crushing of the food products.

It is a further object of the present invention to provide a box for containing multiple circular pizzas that more closely matches the shape of the pizzas so as to make more efficient use of space and box material.

It is yet another object of the present invention to provide a box for containing multiple food products in a vertically stacked relation with proper and adequate support for each food product so that the box does not require additional support devices such as separator stands.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented a box for containing two or more vertically stacked products, such as food products, the box being designed for use in handling and protecting the products during transportation.

In the preferred embodiment, a box for containing a pair of food products, such as pizzas, stacked in a vertical relationship has eight vertical side panels arranged in an overall octagon-shaped enclosure, along with corresponding octagon-shaped horizontal bottom and top panels. On four of the eight vertically-oriented corners or creases where pairs of adjacent side panels meet, there are formed in the panel material corresponding knock-in tabs that act as shelf supports. The knock-in tabs are formed by cutting two parallel horizontal slits for each tab clear through the box material. The horizontal slits extend equidistant from the respective vertically-oriented corner or crease outward in a horizontal direction across the corresponding pair of vertical side panels. The slits terminate at corresponding vertically-oriented creases. The resulting four knock-in tabs are oriented in pairs that are disposed on opposite sides of the box. The knock-in tabs also provide a means of ventilation inside the box. The octagon shape of the box provides a better fit for the normally-round pizzas than prior art square or rectangular-shaped boxes, thereby making more efficient use of the box material. After a first pizza is placed on the bottom surface of the box, each knock-in tab is placed into position by pushing the tab towards the inside of the box. A circular disk is placed on the four tabs and a second pizza is then placed on the disk.

Beside the octagon-shape and knock-in tabs, another unique feature of the box of the present invention is that the octagon-shaped top has a pair of tuck tabs that cooperate with a locking roll-over means on the front side panel of the box to provide for a quick and easy means of opening and closing the box.

DETAILED DESCRIPTION OF THE PREFERRED EMBODIMENTS

Figure 1:
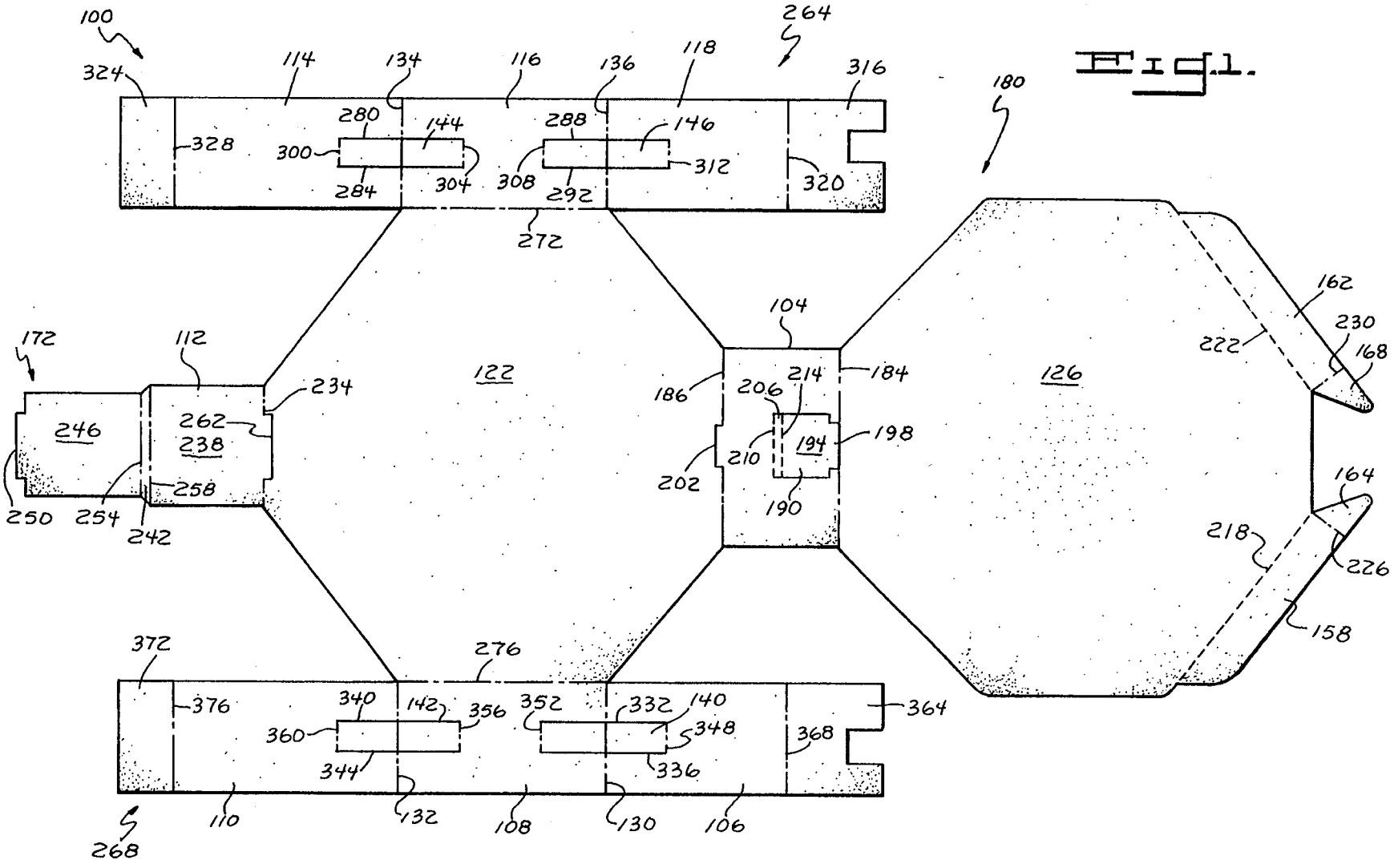
FIG. 1 is a plan view of an unfolded, unitary, prescored corrugated blank used to form the pizza box in accordance with the present invention.

Referring to the drawings in detail, an improved box for containing two or more food products, such as pizzas, stacked in a vertical manner is generally indicated by the reference numeral 100. The box 100 has eight vertical side panels 104–118 arranged in an octagon-shaped enclosure, and also has octagon-shaped horizontal bottom 122 and top 126 panels. On four of the eight vertically-oriented corners or creases 130–136 (i.e., preformed fold lines) where pairs of adjacent side panels 106–108, 108–110, 114–116, 116–118 come together, there are formed in the associated panels corresponding knock-in tabs 140–146 that act as shelf supports. The knock-in tabs 140–146 are pushed inwardly and a disk 150 is placed on top of the four tabs 140–146 so as to support a pizza 154 placed on the disk 150. The octagon-shaped top 126 has a pair of flaps 158, 162 with tuck tabs 164, 168 that cooperate with a locking roll-over means 172 that comprises the front side panel 112 of the box 100 to provide for a quick and easy means of opening and closing the box 100.

Referring to FIG. 1, there illustrated is an unfolded, unitary, pre-scored blank 180 used to form the pizza box 100 of the present invention. The blank 180 may comprise any suitable type of material, such as, for example, corrugated or types of cardboard or fiberboard such as chipboard.

The blank 180 includes top 126 and bottom 122 panels, each being of an octagon shape (i.e., having eight sides). Disposed between the top and bottom panels 126, 122 is an intermediate side panel 104 that is hingedly or foldably attached at preformed fold lines 184, 186 (indicated in phantom) to the corresponding top and bottom panels 126, 122. The intermediate side panel 104 has a locking roll-over 190 cut in a center portion thereof. A portion of the corrugated material comprising the intermediate side panel 104 is cut clear through to form the locking roll-over 190, as indicated by the solid lines. The locking roll-over 190 has a central portion 194 along with a tongue portion 198 that interacts with a slot 202 cut into and through the bottom 122 (as indicated by the solid lines). A bottom portion 206 of the locking roll-over has two parallel horizontal perforated score lines 210, 214 (as indicated by the dotted lines) to facilitate positioning of the tongue portion 198 of the locking roll-over 190 into the slot 202. The locking roll-over 190 is described in more detail hereinafter.

In FIG. 1, all of the perforated score lines are indicated by dotted lines, all of the preformed fold lines are indicated by phantom lines, while all of the cuts made in the blank clear through the corrugated are indicated by solid lines. The overall outline of the blank 180 is indicated by solid lines as well.

The top 126 of the box 100 has a pair of flaps 158, 162 that are hingedly attached to the top 126 at perforated score lines 218, 222. Perforated score lines 218, 222 were chosen because they provide more relief and more definition (versus preformed fold lines) as to where the flaps 158, 162 are going to break. This provides for greater overall ease in assembly of the box. Hingedly attached by preformed fold lines 226, 230 to an end of each of the flaps 158, 162 is a corresponding tuck tab 164, 168. The tuck tabs 164, 168 provide for locking of the top 126 of the box 100 to the remainder of the box, as described in greater detail hereinafter.

Hingedly attached by preformed fold lines 234 to a front portion of the bottom 122 of the box 100 is a second locking roll-over 172 comprising an outer panel 238, an intermediate panel 242 adjacent the outer panel 238, and an inner panel 246 adjacent the intermediate panel 242. The inner panel 246 also has a tongue portion 250 protruding therefrom. The intermediate panel 242 is separated from the outer and inner panels 238, 246 by preformed fold lines 254, 258. A slot 262 is cut through a portion of the bottom 122 of the box adjacent the outer panel 238. In assembly of the box, the tongue portion 250 of the inner panel 246 is inserted into the slot 262.

A pair of panel arrangements 264, 268 are hingedly attached to the bottom 122 of the box 100, on opposite left and right sides thereof, by preformed fold lines 272, 276. The left panel arrangement 264 comprises a middle panel 116 hingedly attached to the bottom 122 of the box 100 by the preformed fold line 272. Flanking either side of the middle panel 116 are outer side panels 114, 118 hingedly attached to the middle panel 116 by corresponding preformed fold lines 134, 136. A pair of knock-in tabs 144, 146 that serve as shelf supports for the final assembled box 100 are formed by cutting, for each tab, a pair of parallel slits 280–284, 288–292 clear through the panel material. The slits 280–284, 288–292 are cut across the corresponding crease 134, 136 that separates the middle panel 116 from the associated outer side panel 114, 118. The slits 280–284,288–292 are cut equidistantly from the creases 134, 136. The corresponding ends of the slits are joined together by preformed fold lines or creases 300–304, 308–312. In the preferred embodiment, the distance between the parallel slits 280–284, 288–292 is, e.g., one inch. As described in greater detail hereinafter with respect to FIGS. 2–4, the four knock-in tabs 140–146 are pushed inwardly into the assembled box 100 so as to provide support for a circular disk 150 upon which a pizza 154 will rest.

At the other end of the upper outer side panel 118 is a locator flap 316 having a portion of the flap material cut out therefrom. The locator flap is hingedly attached by a preformed fold line 320 to the corresponding outer side panel 118. The locator flap 316 cooperates with the locking roll-over 190 on the intermediate side panel 104 between the top 126 and bottom 122 of the box 100. On the opposite end of the lower outer side panel 114 is a tab portion 324 that is hingedly attached by a preformed fold line 328 to the outer side panel 114. The tab 324 cooperates with the locking roll-over 172 disposed on the front part of the bottom 122 of the box 100.

The right panel arrangement 268 is identical to the left panel arrangement 264 hereinbefore described. The right panel arrangement 268 is hingedly attached by a preformed fold line 276 to the right side of the bottom 122 of the box. The right panel arrangement 268 includes middle panel 108 flanked by side panels 106, 110. It also includes knock-in tabs 140, 142 formed with parallel slits 332–344 and corresponding creases 348–360. A locator flap 364 attaches to another side panel 106 by a preformed fold line 368. A tab 372 hingedly attaches to the opposite outer side panel 110 by a preformed fold line 376. All of the aforedescribed features of the corrugated blank 180 of the present invention are formed using standard corrugated cutting dies and techniques.

Figure 2:
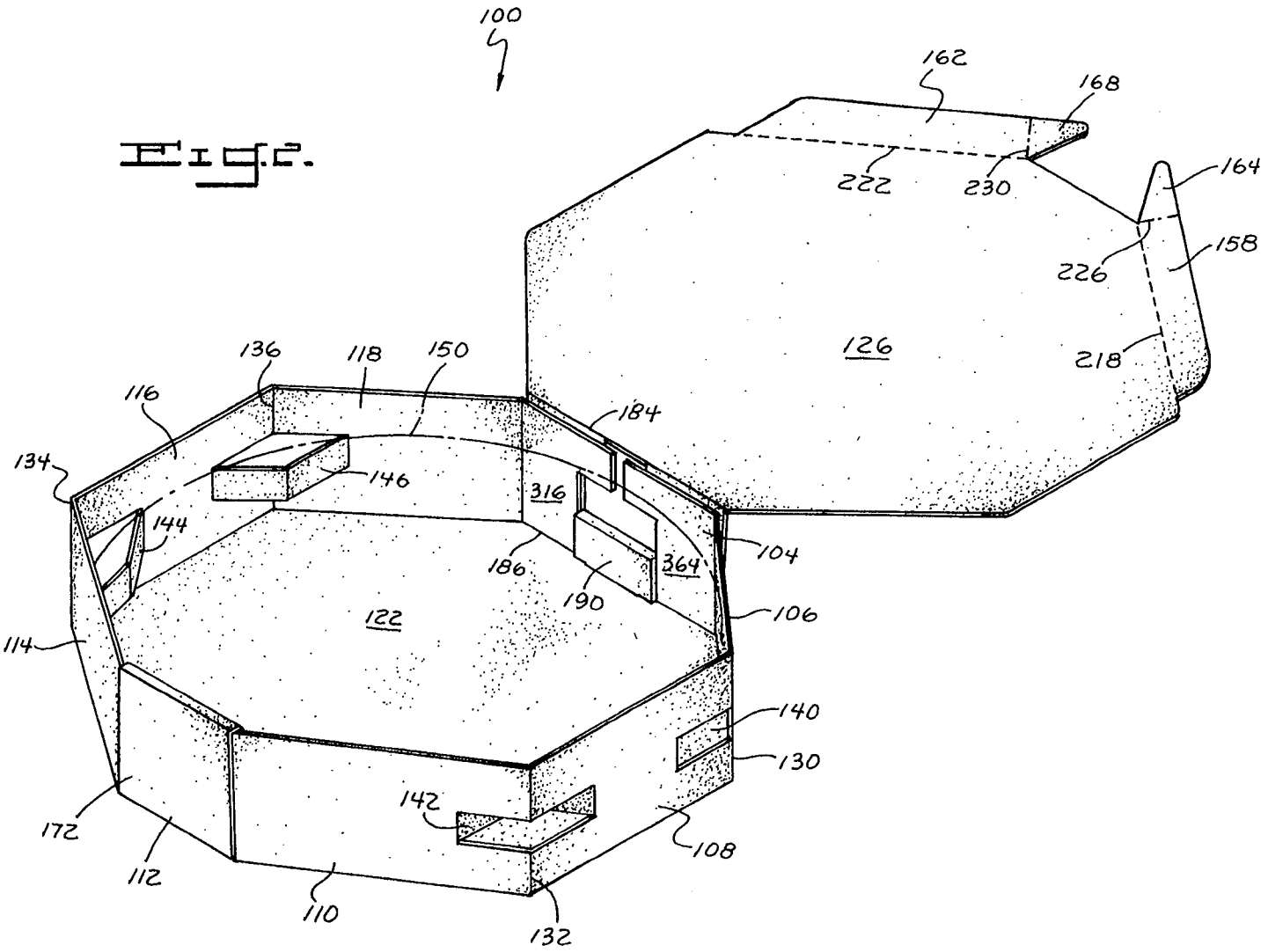
FIG. 2 is a perspective view of the corrugated blank of FIG. 1 assembled to form a box to receive two pizzas.
Figure 3:
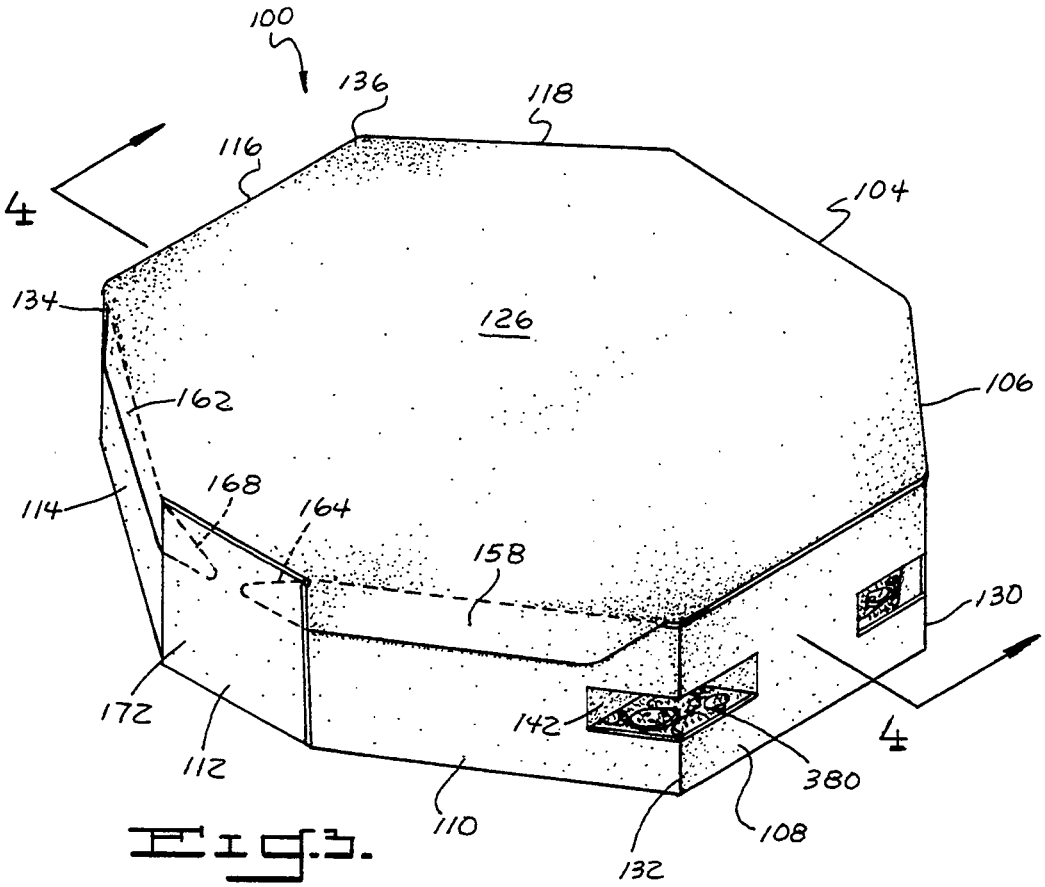
FIG. 3 is a perspective view of the box of FIG. 2 completely assembled with the top closed.
Figure 4:
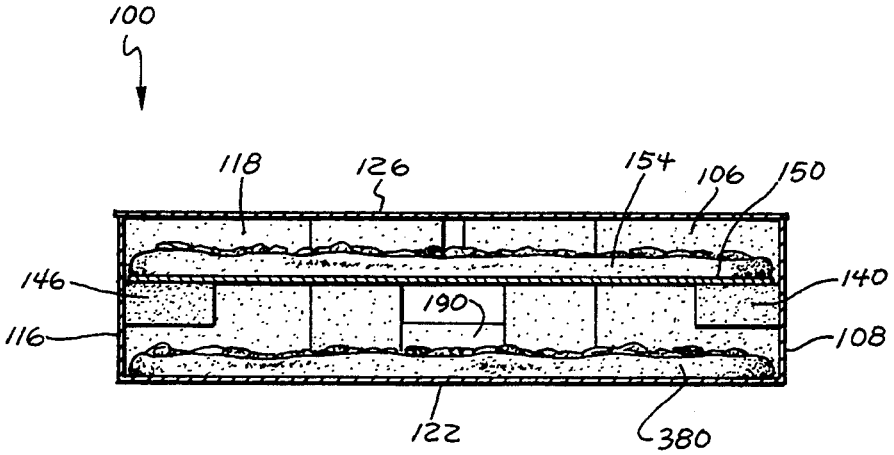
FIG. 4 is a cross-sectional of the box of FIG. 3, having two pizzas therein, taken along the lines 3—3 of FIG. 3.

Referring also to FIGS. 2–4, the box 100 is prepared for loading a pair of pizzas 380, 154 by folding the middle panel 108, 116, of each of the pair of panel arrangements 264, 268, upwardly into an upright position (i.e., perpendicular to the bottom 122 of the box). The corresponding pair of outer side panels 106, 110, 114, 118 of each of the pair of panel arrangements 268, 264 are folded inwardly in an amount such that the bottom surface of each of the outer side panels abuts the corresponding outer surface of the bottom 122 of the box. The front locking roll-over 172 is raised to an upright position by folding the outer panel 238 upwardly to a perpendicular position with respect to the bottom 122 of the box. The outer tab 324, 372 of each of the pair of panel arrangements 264,268 is positioned adjacent the inside surface of the outer panel 238 of the locking roll-over 172. The inner panel 246 of the locking roll-over 172 is then folded over and down towards the bottom 122 of the box such that the tongue portion 250 of the inner panel 246 mates with the corresponding slot 262 in the bottom 122 of the box 100. This secures the pair of outer tabs 372 within the front locking roll-over 172.

The intermediate side panel 104 disposed between the top 126 and bottom 122 of the box 100 is then folded into an upright position with respect to the bottom of the box. The locator flap 316, 364 on each of the pair of panel arrangements 264, 268 is positioned adjacent to the inner surface of the intermediate side panel 104. The locking roll-over 190 disposed on the intermediate side panel 104 is then folded over such that the tongue portion 198 mates with the slot 202 formed in the bottom 122 of the box. This secures the pair of locator flaps 316, 364 within the locking roll-over 190.

The box 100 is now ready to receive a first pizza 380 which is disposed within the box 100 on the bottom 122 or is disposed on a disk (not shown) that is placed on the bottom 122. Next, the four knock-in tabs 140–146 are pushed inwardly towards the inside of the box. The tabs 140–146 form shelf supports that protrude into the interior of the box. A circular disk 150 used to hold a second pizza 154 may now be disposed on top of the knock-in tabs 140–146. A second pizza 154 may then be disposed on top of the circular cardboard disk 150, and the box 100 may then be closed, as illustrated in FIG. 3, by folding the top 126 over and the flaps 158, 162 down, and then inserting the tuck tabs 164, 168 between the outer panel 238 of the front locking roll-over 172 and the outer tab 324, 372 of each of the pair of panel arrangements 264, 268. FIG. 4 illustrates a cross-section of the closed box having the two pizzas 380, 154 disposed therein in a vertical relationship to each other.

It can be seen from FIGS. 1–4 that the vertical height of the resulting eight side panels 104–118 comprising the octagon-shaped enclosure is chosen so as to accommodate the anticipated height of the two pizzas arranged in a vertical orientation. Further, the resulting vertical placement of the set of four knock-in tabs 140–146 that function as shelf supports is chosen with relation to the side panels 104–118 so that a lower pizza 380 can be disposed underneath the set of knock-in tabs 140–146, while an upper pizza 154 is disposed on top of the set of knock-in tabs. The height or thickness of the tabs 140–146 is chosen so as to provide proper support for the anticipated weight of the shelf 150 and associated upper pizza 154 that will be resting on the set of tabs. In the preferred embodiment, wherein the box 100 is comprised of corrugated, the tabs 140–146 have a height of approximately one inch. However, it is to be understood that this height is purely exemplary; any desired amount of vertical height of the tabs 140–146 may be chosen in light of the teachings herein and in light of the type of food product to be packaged.

Note also that with the octagon-shaped box 100 of the present invention, the resulting set of four knock-in tabs 140–146 are disposed more towards the center of the box. This is in contrast to the rectangular box described in the aforementioned '221 patent to Ragan. By supporting the pizza in this manner in accordance with the present invention, the knock-in tabs 140–146 provide better support for the pizza 154 and eliminate the need for an additional support device, such as the aforedescribed separator stand mentioned in the Ragan patent. Eliminating the separator stand through proper location of the knock-in tabs 140–146 allows for other types of food products, such as apple pies, to be housed in the box without damaging the product. It also allows for a clear span (i.e., total clearance) between the top of the lower food product and the bottom of the upper food product. It also means that typically only two items—the blank and a disk—need be purchased, inventoried and assembled. Thus, eliminating the separator stand has a number of benefits, including lower cost.

Further, the angle that the middle side panel 108, 116 makes with the adjacent outer side panels 106, 110, 114, 118 within the pair of panel arrangements 264, 268 is approximately forty-five degrees. In contrast, Ragan teaches an angle between the side panels of ninety degrees. With such a sharp angle as taught in Ragan, the poke-in tabs in Ragan are harder to push in and may not break properly, thereby losing some of its support strength. Thus, the knock-in tabs 140–146 of the octagonal box 100 of the present invention provide for a functional improvement over the tabs described in the rectangular box of Ragan.

The present invention has been described for use in containing a pair of pizzas 380, 154. However, the invention is not limited as such; any type of food product may be packaged in a similar manner in light of the teachings herein. For example, other types of pies, pastries, cakes, grinders or other food products may be packaged in a similar manner. Alternatively, food products housed in their own containers—for example, lasagna or pasta packaged in tin foil or plastic trays—may be housed in the box of the present invention. However, note that the invention is not even limited to food products. Any type of product that is typically transported in a box may be done so by the box of the present invention. It is a simple matter to adjust the overall height of the box for the type, size and weight of food product being packaged, as well as adjusting the resulting vertical placement of the set of knock-in tabs 140–146 to accommodate the different physical characteristics of the products encountered and contemplated by the present invention.

Also, the present invention has been described for use in packaging a pair of food products of similar size. However, it is to be understood that products of dissimilar size may be packaged in light of the teachings herein. Further, the invention is not limited to packaging two items in a vertical relationship to each other. The invention may, if desired, be used to package three or more products in a vertical relationship to each other. For example, if three pizzas are desired to be packaged in the same box, then two sets of knock-in tabs 140–146 are required. The sets of knock-in tabs will be arranged in a vertical manner with respect to each other so as to provide for the proper spacing to allow placement of the products in the desired vertical relationship.

The box has been described as having particular means for securing the side panels. That is, specific locking roll-over mechanisms 172, 190 have been described. However, it is to be understood that such mechanisms are purely exemplary. Other means for adequately securing the side panels 104–118 may be utilized without departing from the broadest scope of the present invention. Also, the top 126 and bottom 122 of the box 100 of the present invention have been described as being octagonal in shape. As mentioned previously, this octagonal shape allows the set of four knock-in tabs 140–146 to be better positioned for proper support of the pizzas therein. However, the octagonal shape has the further benefit of better approximating the circular nature of the pizza 154 and associated disk 150 upon which it rests. In the vast majority of instances, the pizza industry utilizes a circular disk to hold the circular pizza. The octagon shape better approximates this circular configuration. This results in less material being required to fabricate the box, as compared to the rectangular box described in the aforementioned Ragan patent. However, it is a known fact that a greater number of sides than the eight disclosed herein would even better approximate a circular shape. Thus, the broadest scope of the present invention is not limited to an octagon-shaped box. A box having greater than eight sides may be used without departing from the broadest scope of the present invention. Alternatively, a box having less than eight sides may also be used without departing from the broadest scope of the present invention. For example, a box having six sides is contemplated by the present invention and its construction should be apparent to one of ordinary skill in the art in light of the teachings herein.

The present invention has been described as having a pair of flaps 158, 162 and associated tuck tabs 164, 168 attached to the top 126 of the box 100 so as to secure the box in a closed position for transport. It is to be understood, however, that such means for locking the box is purely exemplary. Other methods for securing the box in a closed position may be utilized, if desired.

Besides providing adequate support for a pizza, the knock-in tabs 140–146, while pushed inwardly in the box, have the further benefit of providing a means of ventilation to allow excess moisture or condensation to escape from the box. This prevents the pizzas from becoming soggy during transport.

In the preferred embodiment, the dimensions of the top 126 of the box 100 are such that there is a slight overlap of the box material over the sides of the box. This has the effect of ensuring a proper seal between the top and sides of the box.

The box of the present invention has been described in the preferred embodiment herein as utilizing a disk or shelf 150 to support the upper pizza. The disk rests on the shelf supports comprised of the knock-in tabs 140–146. The disk may be fabricated from corrugated, chipboard or even materials such as plastic. The disk material is irrelevant to the present invention. It is also to be understood that other means for supporting a product may be utilized. Also, the product itself, or its container, may be of a size and shape so that a disk is not needed.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. A box for housing at least two products arranged inside the box in a vertical relationship to one another, comprising:

a. a bottom having an upper surface operable to support one product; and b. at least six sidewalls disposed perpendicular to the bottom upper surface and forming an enclosure surrounding the bottom upper surface, the sidewalls being of a predetermined vertical height sufficient to contain the products arranged inside the box; as characterized by: at least two knock-in tabs, each tab comprising two parallel horizontal slits cut through the sidewall material at the portion of the sidewall material that comprises a single panel thickness of sidewall material, the slits extending across the corresponding vertical corner formed at the intersection of a pair of adjacent sidewalls each comprising a single panel thickness of sidewall material, the intersection of the pair of adjacent sidewalls having the tab formed therein forming an angle of greater than ninety degrees, the slits terminating at their outer dimensions at associated vertically-oriented fold lines disposed on both sides of the corresponding corner, wherein the tabs, when pushed inward toward the inside of the box, form shelf supports that facilitate the housing of the product thereon, and provide for communication of air between the inside of the box and the ambient air outside the box.

2. The box of claim 1, wherein the products comprise food products.

3. The box of claim 2, wherein the food products comprise pizza pies.

4. The box of claim 1, wherein at least two sidewalls are integrally attached to the bottom of the box.

5. The box of claim 1, further comprising a top operable to cover the enclosure formed by the sidewalls.

6. The box of claim 5, wherein the top is integrally attached to at least one sidewall.

7. The box of claim 5, wherein the top further comprises one or more foldable flaps.

8. The box of claim 7, further comprising means for securing a pair of sidewalls on either side of a third sidewall, and for securing the top to a selected one or more locations on one or more corresponding sidewalls.

9. The box of claim 8, wherein the means for securing a pair of sidewalls on either side of a third sidewall, and for securing the top comprises a locking roll-over having an outer panel integrally attached to the bottom of the box, and having an intermediate panel foldably attached to the outer panel, and having an inner panel foldably attached to the intermediate panel, the inner panel having a tongue portion operable to engage a slot formed in the bottom of the box when the inner panel is folded over such that the inner and outer panels are in a parallel planar relationship with a void therebetween having a width determined by the width of the intermediate panel, the locking roll-over comprising the third sidewall to which the pair of sidewalls are secured.

10. The box of claim 1, further comprising means for securing a pair of sidewalls on either side of a third sidewall.

11. The box of claim 10, wherein the means for securing a pair of sidewalls on either side of a third sidewall comprises a locking roll-over having an outer panel integrally attached to the bottom of the box and having an intermediate panel foldably attached to the outer panel, and having an inner panel foldably attached to the intermediate panel, the inner panel having a tongue portion operable to engage a slot formed in the bottom of the box when the inner panel is folded over such that the inner and outer panels are in a parallel planar relationship with a void therebetween having a width determined by the width of the intermediate panel.

12. The box of claim 6, wherein the sidewall that is integrally attached to the top is also integrally attached to the bottom of the box, the sidewall having a locking roll-over means disposed therein comprising a main panel section foldably attached to an intermediate panel that is foldably attached to the sidewall, the main panel section having a tongue portion operable to engage a slot formed in the bottom of the box when the main panel section is folded over such that the main panel and the sidewall are in a parallel planar relationship with a void therebetween having a width determined by the width of the intermediate panel, the locking roll-over means comprising means for securing a pair of sidewalls on either side of the sidewall integrally attached to both the top and bottom of the box.

13. The box of claim 1, having one of the sidewalls integrally attached to the bottom of the box, the sidewall having a locking roll-over means disposed therein comprising a main panel section foldably attached to an intermediate panel that is foldably attached to the sidewall, the main panel section having a tongue portion operable to engage a slot formed in the bottom of the box when the main panel section is folded over such that the main panel section and the sidewall are in a parallel planar relationship with a void therebetween having a width determined by the width of the intermediate panel, the locking roll-over means comprising means for securing a pair of sidewalls on either side of the sidewall integrally attached to the bottom of the box.

14. The box of claim 1, wherein the knock-in tabs are arranged in a set, each of the knock-in tabs within a set of tabs has an upper edge that is equal in vertical height above the bottom of the box as all other upper edges of associated tabs in a corresponding set of tabs.

15. The box of claim 14, having a plurality of sets of tabs, each set of tabs being disposed at different vertical heights above the bottom of the box, the vertical distance between the tabs being sufficient to accommodate the vertical height of the product, the number of sets of tabs being one less than the number of vertical layers of products housed within the box.

16. The box of claim 1, further comprising means for supporting one or more of the products, the means for supporting being disposed in physical relation to the knock-in tabs such that the knock-in tabs provide support for the means for supporting.

17. A box for housing two or more products arranged inside the box in a vertical relationship to one another, comprising:

a. a box having an upper surface operable to support one or more of the products;

b. a top; and c. at least six sidewalls disposed perpendicular to the bottom upper surface and forming an enclosure surrounding the bottom upper surface, the sidewalls being of a predetermined vertical height sufficient to contain the products arranged inside the box; as characterized by at least two knock-in tabs, each tab comprising two parallel horizontal slits cut through the sidewall material at the portion of the sidewall material that comprises a single panel thickness of sidewall material, the slits extending across the corresponding vertical corner formed at the intersection of a pair of adjacent sidewalls each comprising a single panel thickness of sidewall material, the intersection of the pair of adjacent sidewalls having the tab formed therein forming an angle of greater than ninety degrees, the slits terminating at their outer dimensions at associated vertically-oriented fold lines disposed on both sides of the corresponding corner, wherein the tabs, when pushed inward toward the inside of the box, form shelf supports that facilitate the housing of the one or more products thereon, and provide for communication of air between the inside of the box and the ambient air outside the box.

18. The box of claim 17, wherein the top is integrally attached to at least one sidewall.

19. The box of claim 17, further comprising means for securing a pair of sidewalls on either side of a third sidewall.

20. The box of claim 19, wherein the means for securing a pair of sidewalls on either side of a third sidewall comprises a locking roll-over having an outer panel integrally attached to the bottom of the box, and having an intermediate panel foldably attached to the outer panel, and having an inner panel foldably attached to the intermediate panel, the inner panel having a tongue portion operable to engage a slot formed in the bottom of the box when the inner panel is folded over such that the inner and outer panels are in a parallel planar relationship with a void therebetween having a width determined by the width of the intermediate panel.

21. The box of claim 17, further comprising means for securing a pair of sidewalls on either side of a third sidewall, and for securing the top to one or more sidewalls such that the top is in a closed position with respect to the inside of the box.

22. The box of claim 21, wherein the means for securing a pair of sidewalls on either side of a third sidewall and for securing the top to one or more sidewalls comprises a locking roll-over having an outer panel integrally attached to the bottom of the box, and having an intermediate panel foldably attached to the outer panel, and having an inner panel foldably attached to the intermediate panel, the inner panel having a tongue portion operable to engage a slot formed in the bottom of the box when the inner panel is folded over such that the inner and outer panels are in a parallel planar relationship with a void therebetween having a width determined by the width of the intermediate panel.

23. The box of claim 17, wherein the products comprise food products.

24. The box of claim 17, wherein the products comprise pizzas.

* * * * *